US005472663A

United States Patent [19]

Kitamura et al.

[11] Patent Number: 5,472,663

[45] Date of Patent: Dec. 5, 1995

[54] NI-BASED ALLOY SPARKING PLUG ELECTRODE MATERIAL FOR USE IN AN INTERNAL COMBUSTION ENGINE

[75] Inventors: Hideo Kitamura; Kensho Sahira; Akira Mimura, all of Saitama, Japan

[73] Assignee: Mitsubishi Materials Corporation, Tokyo, Japan

[21] Appl. No.: 85,599

[22] Filed: Jul. 1, 1993

[30] Foreign Application Priority Data

Jul. 1, 1992 [JP] Japan ..... 4-197669

[51] Int. Cl.[6] ..... C22C 19/03

[52] U.S. Cl. ..... 420/441; 148/428; 148/429; 420/445; 420/452; 420/459; 420/460

[58] Field of Search ..... 420/441, 445, 420/452, 459, 460; 148/428, 429

[56] References Cited

U.S. PATENT DOCUMENTS 4,400,210 8/1983 Kudo et al. ..... 420/452

FOREIGN PATENT DOCUMENTS 2221222 1/1990 United Kingdom .

*Primary Examiner*—David A. Simmons
*Assistant Examiner*—Robert R. Koehler
*Attorney, Agent, or Firm*—Vineet Kohli; Thomas R. Morrison

[57] ABSTRACT

To improve high-temperature strength, as well as increased resistance to wear due to sparking, a Ni-based alloy sparking plug electrode material for use in an internal combustion engine is provided. Such a Ni-based alloy sparking plug electrode material contain, by weight, from 3.1 to 4.3 of Al, from 0.5 to 1.5% of Si, from 0.45 to 0.65% of Mn, from 0.002 to 0.01% of C, from 0.005 to 0.05% of at least one of Mg and Ca, and, as necessitated, from to 2% of Cr, with the balance substantially Ni and inevitable impurities.

2 Claims, 1 Drawing Sheet

NI-BASED ALLOY SPARKING PLUG ELECTRODE MATERIAL FOR USE IN AN INTERNAL COMBUSTION ENGINE

BACKGROUND OF THE INVENTION

The present invention relates generally to a Ni-based alloy electrode material and, more particularly, to a Ni-based sparking plug material for use in an internal combustion engine. Such a sparking plug exhibits improved high-temperature strength and increased resistance to wear due to sparking, when compared to conventional sparking plugs.

Generally, the electrode material of a sparking plug for use in internal combustion engines is required to simultaneously satisfy the demand for high-temperature strength coupled with high resistance to wear, which results from sparking. To meet such a requirement, Ni-based alloy materials are used today, such as for example, a Ni-based alloy disclosed in Japanese Patent Laid-Open No. 2-34735, having a composition containing, by weight, from 3.1 to 5% of Al, from 0.5 to 1.5% of Si, from 0.1 to 0.65% of Mn, and, as necessitated, from 0.1 to 2% of Cr, the balance substantially being Ni and inevitable impurities.

In recent years, remarkable improvements both in performance and output power of internal combustion engines such as automotive engines have been made, resulting in a need for sparking plug electrode materials having high-temperature strength and improved resistance to wear due to sparking. Consequently, there is a need for sparking plug electrodes which will operate under such severe operating conditions. Unfortunately, conventional Ni-based alloy sparking plug electrode materials, including the above-mentioned Ni-based alloy sparking plug electrodes, are unable to perform under such severe conditions, due to their lack of high-temperature strength and low resistance to wear due to sparking. The inability of the conventional sparking plug electrodes combined with a low resistance to wear has greatly reduced the life expectancy of conventional sparking plug electrodes.

As a result of the foregoing problems related to conventional sparking plugs, the present inventors have endeavored to develop a Ni-based alloy sparking plug electrode material with improved strength at high temperature and increased resistance to wear due to sparking.

The inventors have discovered that Ni-based alloy sparking plug electrode materials with improved strength at high temperature, and increased resistance to wear due to sparking, can be developed when the contents by weight of components such as Al, Si, and Mn coupled with the content of Cr, are respectively present in specified concentrations. The inventors have discovered the specified concentrations of the above mentioned components to be as follows:

Al: from 3.1 to about 4.3%,

Si: from 0.5 to about 1.5%,

Mn: from 0.45 to about 0.65%,

Cr: from 1 to 2%, and

C: from 0.002 to 0.01 wt %, as an alloying component.

Additionally, the concentration of at least one of Mg and Ca should be from 0.005 to 0.05%.

OBJECTS AND SUMMARY OF THE INVENTION

Accordingly, it is an object of the present invention to provide a Ni-based alloy electrode material of a sparking plug for use in an internal combustion engine, which exhibits improved strength at a high temperature, and increased resistance to wear due to its sparking.

Briefly stated, the present invention is a Ni-based alloy sparking plug material for use in an internal combustion engine which comprises, by weight of from 3.1 to 4.3% of Al, from 0.5 to 1.5% of Si, from 0.45 to 0.65% of Mn, from 0.002 to 0.01% of C, from 0.005 to 0.05% of at least one of Mg and Ca, and, as necessitated, from 1 to 2% of Cr, with the balance substantially Ni and inevitable impurities.

The above and other objects and advantages of the present invention will become apparent from the following description read in conjunction with the accompanying drawings and tables where the reference numerals designate the same elements.

DETAILED DESCRIPTION OF THE PREFERRED EMBODIMENT

Figure 1:
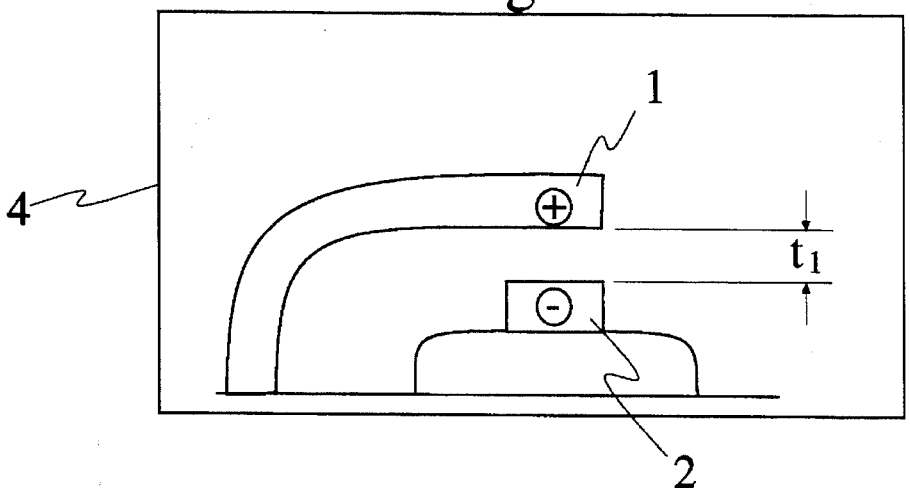
FIG. 1 is a diagram illustrating an embodiment of the present invention before an engine test.

Referring to FIG. 1, the diagram illustrates an embodiment of the present invention before an engine test. A gap $t_1$ is an initial electrode gap of the Ni-based alloy sparking plug electrode material of the present invention. FIG. 1 illustrates a Ni-based alloy sparking plug electrode material having a grounded electrode 1 and a central electrode 2. Central electrode 2 and grounded electrode 1 are cut out and welded to a sparking plug 4 with gap $t_1$ equivalent to 0.8 min.

Figure 2:
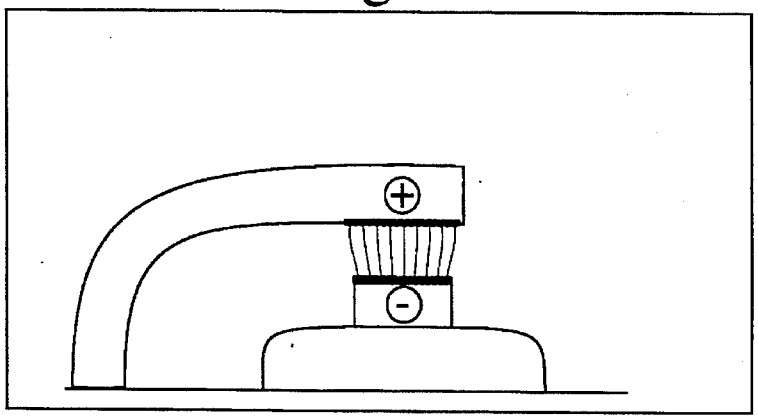
FIG. 2 is a diagram illustrating an embodiment of the present invention during an engine test.

Referring to FIG. 2, the diagram illustrates an embodiment of the present invention during an engine test. Sparking plug 4 is displaced in a turbo-charged spark ignited engine having a displacement of 2500 cc and operating at 6000 rpm.

Figure 3:
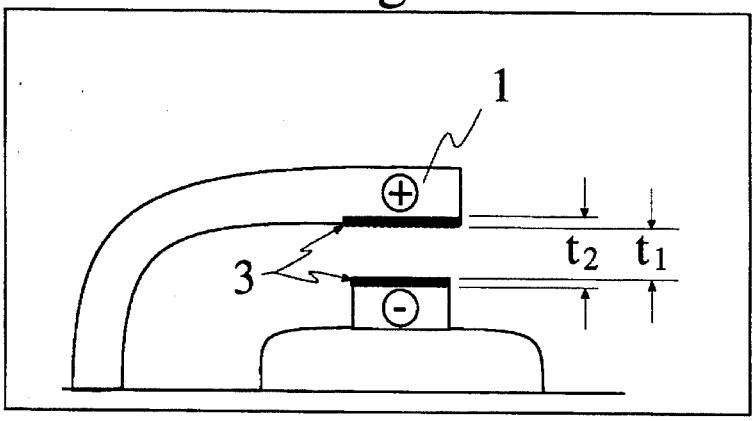
FIG. 3 is a diagram illustrating an embodiment of the present invention after an engine test.

Referring to FIG. 3, the diagram illustrates an embodiment of the present invention after an engine test. The figure shows the status of sparking plug 4 after 200 hours of testing time. A gap $t_2$ is the electrode gap after the engine test. A difference 3, illustrated in FIG. 3, between $t_2$–$t_1$ is the gap increment. Difference 3 (Gap increment) $t_2$–$t_1$ represents wear due to sparking.

A detailed description of the examples of the Ni-based alloy sparking plug electrode material of the present invention follows. The contents are expressed in terms of percents by weight (wt %).

(a) ALUMINUM (Al)

Al is an element which effectively improves strength at a high temperature. The strengthening effect produced by Al, however, is not appreciable when the content of Al is below 3.1 wt %. An Al content in excess of 4.3%, undesirably impairs workability of the alloy. The Al content, therefore, should be in a range from about 3.1 to about 4.3%.

(b) Silicon (Si)

Si is effective in improving resistance to wear due to sparking. This effect, however, is not sufficient when the Si content is below 0.5%. At the same time, the effect to improve the resistance to wear due to sparking is substantially impaired when the Si content exceeds 1.5%. The content, therefore, is limited to a range from 0.5 to about 1.5%.

(c) Manganese (Mn)

Mn promotes deoxidation and desulfurization, thus contributing to an improvement in strength at a high temperature. This property is hindered when the Mn content is below 0.45%. On the other hand, resistance to wear due to sparking is impaired when the Mn content is increased beyond 0.65%. The Mn content preferably ranges from about 0.45 to 0.65%.

(d) Carbon (C)

C serves to further improve the strength of the electrode material at a high temperature in cooperation with Al and Mn. The strengthening effect, however, is not appreciable when the C content is below 0.002%. At the same time, C content exceeding 0.02% impairs the welding ability of the electrode material to the main part of the sparking plug. The C content, preferred to be from 0.002% to 0.01%.

(e) Magnesium (Mg) and/or Calcium (Ca)

Mg and/or Ca contribute to further improvement in the resistance to wear due to sparking, particularly in the presence of Si. This property, however, is not apparent when the content of Mg and/or Ca is less than 0.005%. At the same time, this property tends to decrease when the content exceeds 0.05%. For these reasons, the content of Mg and/or Ca should preferably be from about 0.005 to about 0.05%.

(f) Chromium (Cr)

The presence of Cr further enhances the strength of the electrode material at high temperature and, therefore, is added as required. The desired strengthening effect cannot be obtained when Cr content is less than 1%, while Cr content exceeding 2% impairs workability. The Cr content, therefore, should be from about 1 to about 2%.

EXAMPLES

In the following description of the examples, contents of components are expressed in terms of percents by weight (wt %).

TABLE 1

| Types | COMPOSITION OF Ni-BASED ALLOY | | | | | | | | HIGH-TEMP. STRENGTH (kgi/mm$^2$) | GAP INCREMENT (mm) |
|---|---|---|---|---|---|---|---|---|---|---|
| | Al | Si | Mn | C | Mg | Ca | Cr | Ni + IMPURITY | | |
| SPARKING PLUG ELECTRODE MATERIAL OF INVENTION | | | | | | | | | | |
| 1 | 3.12 | 0.75 | 0.59 | 0.0061 | 0.025 | — | — | Bal. | 13.6 | 0.17 |
| 2 | 3.63 | 0.80 | 0.52 | 0.0056 | 0.026 | — | — | Bal. | 14.0 | 0.16 |
| 3 | 4.25 | 0.77 | 0.47 | 0.0054 | 0.027 | — | — | Bal. | 14.1 | 0.16 |
| 4 | 3.54 | 0.52 | 0.63 | 0.0059 | 0.021 | 0.024 | — | Bal. | 13.8 | 0.12 |
| 5 | 3.51 | 1.48 | 0.50 | 0.0055 | — | 0.0058 | — | Bal. | 14.0 | 0.18 |
| 6 | 3.80 | 0.80 | 0.55 | 0.0022 | 0.0032 | 0.0029 | — | Bal. | 13.8 | 0.17 |
| 7 | 3.62 | 0.79 | 0.49 | 0.0094 | 0.027 | — | — | Bal. | 14.2 | 0.15 |
| 8 | 3.57 | 0.77 | 0.64 | 0.0060 | 0.0054 | — | — | Bal. | 13.9 | 0.13 |
| 9 | 3.68 | 0.81 | 0.52 | 0.0053 | 0.043 | — | — | Bal. | 14.0 | 0.12 |
| 10 | 3.47 | 0.13 | 0.54 | 0.0067 | — | 0.086 | — | Bal. | 13.8 | 0.14 |

TABLE 2

| Types | COMPOSITION OF Ni-BASED ALLOY | | | | | | | | HIGH-TEMP. STRENGTH (kgi/mm²) | GAP INCREMENT (mm) |
|---|---|---|---|---|---|---|---|---|---|---|
| | Al | Si | Mn | C | Mg | Ca | Cr | Ni + IMPURITY | | |
| SPARKING PLUG ELECTRODE MATERIAL OF INVENTION | | | | | | | | | | |
| 11 | 3.61 | 0.80 | 0.61 | 0.0054 | — | 0.047 | — | Bal. | 13.9 | 0.15 |
| 12 | 3.58 | 0.17 | 0.63 | 0.0057 | 0.028 | — | 1.1 | Bal. | 14.9 | 0.16 |
| 13 | 3.59 | 0.79 | 0.54 | 0.0060 | — | 0.023 | 1.3 | Bal. | 15.2 | 0.16 |
| 14 | 3.60 | 0.81 | 0.52 | 0.0063 | 0.013 | 0.019 | 1.8 | Bal. | 15.5 | 0.17 |
| 15 | 3.62 | 0.78 | 0.80 | 0.0059 | 0.0029 | 0.0027 | 1.4 | Bal. | 15.3 | 0.18 |
| KNOWN SPARKING PLUG ELECTRODE MATERIAL | | | | | | | | | | |
| 1 | 3.13 | 0.75 | 0.60 | — | — | — | — | Bal. | 10.3 | 0.28 |
| 2 | 3.60 | 0.82 | 0.54 | — | — | — | — | Bal. | 10.8 | 0.23 |
| 3 | 4.25 | 0.75 | 0.48 | — | — | — | — | Bal. | 11.1 | 0.31 |
| 4 | 3.49 | 1.42 | 0.54 | — | — | — | — | Bal. | 10.8 | 0.20 |
| 5 | 3.59 | 0.80 | 0.62 | — | — | — | — | Bal. | 12.1 | 0.28 |

Referring to Tables 1 and 2, Ni-based alloys having compositions as shown, were melt-produced in an ordinary vacuum melting furnace. In order to add C, Mg and Ca as alloying components, SiC, Ni-Mg alloy (Mg: 20%) and Ni-Ca alloy (Ca:15%) were used as the materials. Ingot were formed from Ni-based alloys by vacuum casting, and bars having a circular cross section of 10 mm diameter were formed from the ingots by hot forging.

Test pieces for the high-temperature tensile test, having a cross-section of 6 mm in length and 2 mm in width, were obtained from the bars by cutting. The bars were also subjected to a hot wire drawing process so as to form a wire with a 2.5 mm diameter, whereby example nos. 1 to 15 of the sparking plug electrode material of the present invention, as well as comparative example nos. 1 to 5 (conventional electrode materials) were obtained.

The above-mentioned test pieces were subjected to a tensile test conducted at 850° C., for the purpose of evaluating the tensile strength of the pieces at high temperature. Meanwhile, the above-mentioned examples and comparative examples of the sparking plug electrode materials were also subjected to tests conducted for the purpose of evaluating the resistance of the sparking-plug materials to wear due to sparking.

Henceforth, a central electrode and a grounded electrode were cut out of each of the example materials and comparative example materials. The respective electrode materials were welded to a sparking plug body with an initial electrode gap of 0.8 min. Each of the sparking plugs thus obtained were tested on an actual turbo-charged spark-ignited engine having a displacement of 2500 cc operating at 6000 rpm. After running the engine for 200 hours, the increments of the electrode gap in the sparking plugs were measured in order to obtain the results, as shown in tables 1 and 2.

From the test results shown in Tables 1 and 2, it is patently clear that example nos. 1 to 15 of the sparking plug electrode material of the present invention exhibited improved high temperature strength, and increased resistance to wear from sparking over comparative examples nos. 1 to 5 formed from conventional materials. This improvement results from the addition of C, and Mg and/or Ca as the alloying components.

As will be understood from the foregoing description, the Ni-based alloy sparking plug electrode material of the present invention exhibits improved high temperature strength and increased resistance to wear due to sparking over a remarkably long period of time. Additionally, the Ni-based alloy sparking plug electrode material of the present invention is better able to cope with the demands for increased power output and higher operating speed of various internal combustion engines.

Having described preferred embodiments of the invention with reference to tables and examples, it is to be understood that the invention is not limited to the precise embodiments and that various changes and modifications may be affected therein by one skilled in the art without departing from the scope or spirit of the invention which is limited only by the appended claims.

What is claimed is:

1. A Ni-based alloy sparking plug electrode material for use in an internal combustion engine, comprising:

a Ni-based alloy containing, by weight percent;

from about 3.1 to 4.3% of Al;

from about 0.5 to about 1.5% of Si;

from about 0.45 to about 0.65% of Mn;

from about 0.002 to about 0.01% C;

from about 0.005 to about 0.05% of at least one element selected from the group consisting of Mg and Ca, whereby said at least one of Mg and Ca are effective when present with Si; and a balance consisting substantially of Ni and inevitable impurities.

2. A Ni-based sparking plug electrode material for use in an internal combustion, comprising:

a Ni-based alloy containing, by weight percent:

from about 3.1 to 4.3% of Al;

from about 0.5 to about 1.5% of Si;

from about 0.45 to about 0.65% of Mn;

from about 0.002 to about 0.01% of C;

from about 0.005 to about 0.05% of at least one element selected from the group consisting of Mg and Ca, whereby said at least one of Mg and Ca is effective when present with Si;

from about 1 to about 2 percent of Cr; and a balance substantially consisting of Ni and inevitable impurities.

* * * * *